US009144115B2

(12) United States Patent
Usui et al.

(10) Patent No.: US 9,144,115 B2
(45) Date of Patent: Sep. 22, 2015

(54) INDUCTION COOKING DEVICE

(75) Inventors: Kenzo Usui, Hyogo (JP); Hidekazu Suzuki, Hyogo (JP); Taihei Oguri, Hyogo (JP); Hiroyuki Katsube, Hyogo (JP); Kohei Kawata, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 772 days.

(21) Appl. No.: 13/394,365

(22) PCT Filed: Jan. 28, 2011

(86) PCT No.: PCT/JP2011/000491

§ 371 (c)(1), (2), (4) Date: Mar. 6, 2012

(87) PCT Pub. No.: WO2011/093100

PCT Pub. Date: Aug. 4, 2011

(65) Prior Publication Data

US 2012/0160831 A1 Jun. 28, 2012

(30) Foreign Application Priority Data

| | | |
|---|---|---|
| Jan. 29, 2010 | (JP) | 2010-018168 |
| Jan. 29, 2010 | (JP) | 2010-018170 |
| Jan. 29, 2010 | (JP) | 2010-018171 |
| Jan. 29, 2010 | (JP) | 2010-018172 |
| Jan. 29, 2010 | (JP) | 2010-018173 |

(51) Int. Cl.
*H05B 6/06* (2006.01)
*H05B 3/68* (2006.01)
(Continued)

(52) U.S. Cl.
CPC ..... *H05B 6/062* (2013.01); *F24C 15/102* (2013.01)

(58) Field of Classification Search
CPC ..... H05B 3/746; H05B 6/062; H05B 2213/05
USPC ..... 219/601, 622, 626, 627, 625, 662, 219/121.48, 443.1, 447.1, 480, 482, 487, 219/506, 660, 665; 362/231; 392/443, 447, 392/480, 482, 487, 506
See application file for complete search history.

(56) References Cited

U.S. PATENT DOCUMENTS

| | | | | |
|---|---|---|---|---|
| 4,446,350 | A | 5/1984 | Mizukawa et al. | |
| 2008/0099449 | A1 * | 5/2008 | England et al. | 219/121.48 |

(Continued)

FOREIGN PATENT DOCUMENTS

| | | | |
|---|---|---|---|
| EP | 0 429 120 | A2 | 5/1991 |
| EP | 2 117 282 | A1 | 11/2009 |

(Continued)

OTHER PUBLICATIONS

Office Action in corresponding Canadian Application No. 2,782,606, dated Apr. 24, 2014, 2 pages.

(Continued)

*Primary Examiner* — Quang Van
(74) *Attorney, Agent, or Firm* — Brinks Gilson & Lione

(57) ABSTRACT

An induction cooking device includes a light-pervious top plate on which a container with liquid contained therein is to be placed. A heating coil resides below the top plate to heat the container. An electrode is located at a portion of a lower surface of the top plate outward of a periphery of the heating coil. A capacitance detection device detects changes in capacitance of the electrode caused by liquid boiled over from the container. The top plate includes a light emitting part by which visible light, applied from a light source placed below the top plate, is transmitted to fulfill light emission. The light emitting part is located at a portion of the top plate between the periphery of the heating coil and the electrode, as viewed from above the top plate.

7 Claims, 3 Drawing Sheets

(51) Int. Cl.
*H05B 3/78* (2006.01)
*F24C 15/10* (2006.01)

(56) References Cited

U.S. PATENT DOCUMENTS

| | | | | |
|---|---|---|---|---|
| 2009/0303201 | A1 | 12/2009 | Isoda et al. | |
| 2010/0096382 | A1 | 4/2010 | Sakakibara et al. | |
| 2010/0187216 | A1* | 7/2010 | Komada et al. | 219/443.1 |
| 2011/0309069 | A1 | 12/2011 | Fujinami et al. | |

FOREIGN PATENT DOCUMENTS

| | | | |
|---|---|---|---|
| JP | 58-128691 | A | 8/1983 |
| JP | 61/243690 | A | 10/1986 |
| JP | 3-119683 | A | 5/1991 |
| JP | 2001-297864 | A | 10/2001 |
| JP | 2003-224459 | A | 8/2003 |
| JP | 2004-171855 | A | 6/2004 |
| JP | 2005-166392 | A | 6/2005 |
| JP | 2005-257202 | A | 9/2005 |
| JP | 2007-220388 | A | 8/2007 |
| JP | 2008-159494 | A | 7/2008 |
| JP | 2008-177010 | | 7/2008 |
| JP | 2009-099365 | A | 5/2009 |
| JP | 2009-218106 | A | 9/2009 |
| WO | WO 2008/084829 | A1 | 7/2008 |
| WO | WO 2008/090887 | A1 | 7/2008 |
| WO | WO 2010/079583 | A1 | 7/2010 |

OTHER PUBLICATIONS

Office Action in corresponding Canadian Application No. 2,782,604, dated May 12, 2014, 3 pages.
Office Action in corresponding Canadian Application No. 2,782,605, dated May 14, 2014, 3 pages.
Office action from Chinese Application No. 201180003698.7, dated Feb. 20, 2014 (with English translation of search report), 9 pages.
Office Action in co-pending U.S. Appl. No. 13/394,366, dated June 28, 2013, 15 pages.
Office Action in U.S. Application No. 13/394,280, entitled "Cooking Device," Kawata et al., dated May 3, 2013, 14 pages.
Office Action from Chinese Application No. 201180003697.2, dated Mar. 14, 2014 (with English translation of Search Report), 8 pages.
Office Action from Chinese Application No. 201180003696.8, dated Mar. 25, 2014 (with English translation of Search Report) 9 pages.
Supplementary European Search Report in corresponding European Application No. 11 73 6815, dated Jan. 7, 2014, 6 pages.
Supplementary European Search Report in related European Application No. 11 73 6814.2, dated Jan. 7, 2014, 6 pages.
Supplementary European Search Report in related European Application No. 11 73 6816.7, dated Jan. 7, 2014, 6 pages.
International Search Report for International Application No. PCT/JP2011/000491, dated May 10, 2011, 7 pages.
International Preliminary Report on Patentability for International Application No. PCT/JP2011/000491, dated Sep. 18, 2012, 9 pages.
Office Action issued in corresponding U.S. Appl. No. 13/394,280, dated Aug. 20, 2013, 11 pages.
International Search Report for International Application No. PCT/JP2011/000490, dated May 17, 2011, 4 pages.
International Search Report for International Application No. PCT/JP2011/000493, dated May 17, 2011, 4 pages.
International Search Report on Patentability for International Application No. PCT/JP2011/000490, dated Sep. 18, 2012, 8 pages.
International Preliminary Report on Patentability for International Application No. PCT/JP2011/000493, dated Sep. 18, 2012, 8 pages.
Office Action from co-pending U.S. Appl. No. 13/394,366, dated Mar. 12, 2013, 8 pages.
Office Action and Search Report, and partial English Translation thereof, in corresponding Chinese Application No. 201180003697.2, dated Jul. 2, 2013, 8 pages.
Advisory Action issued in co-pending U.S. Appl. No 13/394,366, dated Dec. 4, 2013, 5 pages.

* cited by examiner

INDUCTION COOKING DEVICE

This application is a 371 application of PCT/JP2011/000491 having an international filing date of Jan. 28, 2011, which claims priority to JP2010-018173 filed Jan. 29, 2010, JP2010-018172 filed Jan. 29, 2010, JP2010-018171 filed on Jan. 29, 2010, JP2010-018170 filed Jan. 29, 2010 and JP2010-018168 filed Jan. 29, 2010, the entire contents of which are incorporated herein by reference.

TECHNICAL FIELD

The present invention relates to an induction cooking device for use in home kitchens or business-use cooking rooms or the like.

BACKGROUND ART

Conventionally, an induction cooking device has electrodes for detecting liquid as a cooking object boiled over from a container, the electrode being provided in a lower surface of a top plate on which the container is to be placed. When the liquid boiled over from the container reaches a portion of the top plate positioned above the electrode, the electrode changes in capacitance. Based on this change in capacitance of the electrode, the induction cooking device performs control for heating. Such an induction cooking device is described in Patent Literature 1 as an example.

PTL1: JP 2008-159494 A

SUMMARY OF THE INVENTION

Technical Problem

However, in the induction cooking device of the above-described constitution, on condition that the container is present at the top plate part positioned above the electrode, the electrode, above which the container is positioned, does not change in capacitance even upon boiling-over of the liquid, so that the electrode could not detect the boiled-over liquid. Also, when the container is moved to above the electrode by user's handling of the container during heating, the electrode may change in capacitance, causing a possibility that boiling-over of the liquid may be mis-detected whereas the liquid is not boiled over from the container.

Accordingly, an object of the invention is to provide an induction cooking device in which placement of the container onto a top plate part positioned above the electrode by a user can be suppressed so that the possibility that boiling-over of the liquid may be mis-detected notwithstanding no boiling-over of the liquid from the container can be reduced, thus enabling the induction cooking device being enabled to detect boiling-over of the liquid from the container with high accuracy and being highly user-friendly.

Solution to Problem

In order to achieve the above object, the present invention has the following constitutions.

According to a first aspect of the present invention, there is provided an induction cooking device comprising:

a light-pervious top plate on which a container is to be placed;

a heating coil provided below the top plate to heat the container;

an electrode provided at a portion of a lower surface of the top plate positioned outer than a periphery of the heating coil; and a capacitance detection device for detecting changes in capacitance of the electrode caused by liquid boiled over from the container, wherein the top plate includes a light emitting part by which visible light applied from a light source placed below the top plate is transmitted to fulfill light emission, the light emitting part being positioned at a portion of the top plate positioned between the periphery of the heating coil and the electrode as viewed from above the top plate.

According to a second aspect of the present invention, there is provided the induction cooking device according to the first aspect of the present invention, wherein the light emitting part is formed into an annular shape having a center positioned nearly identical to a center of the heating coil as viewed from above the top plate.

According to a third aspect of the present invention, there is provided the induction cooking device according to the first aspect of the present invention, wherein the light emitting part is formed into an arc shape having a center positioned nearly identical to a center of the heating coil as viewed from above the top plate.

According to a fourth aspect of the present invention, there is provided the induction cooking device according to the first aspect of the present invention, wherein the light emitting part is formed into an arc shape having a center positioned nearly identical to a center of the heating coil, and moreover is placed at a portion of the top plate on a front side of the induction cooking device with respect to the heating coil.

According to a fifth aspect of the present invention, there is provided the induction cooking device according to the first aspect of the present invention, wherein the light source is made variable in its light-application area or light color based on a heating output of the heating coil, and the light emitting part is formed at a portion of the top plate on a front side of the induction cooking device with respect to the heating coil.

According to a sixth aspect of the present invention, there is provided the induction cooking device according to the first aspect of the present invention, wherein the electrode is formed in a plural-band-like shape along the outer periphery of the heating coil.

According to a seventh aspect of the present invention, there is provided the induction cooking device according to the sixth aspect of the present invention, wherein the plurality of electrodes are formed in a nearly identical circumference as viewed from above.

Advantageous Effects of Invention

According to this invention, there can be provided an induction cooking device in which placement of the container onto the top plate part positioned above the electrode by the user can be suppressed, thus the induction cooking device having high detection accuracy for the liquid boiled over from the container.

BRIEF DESCRIPTION OF THE DRAWINGS

The above aspects and features of the present invention will become more apparent from the following description of preferred embodiments thereof with reference to the accompanying drawings, and wherein.

DETAILED DESCRIPTION OF THE PREFERRED EMBODIMENTS

Figure 1:
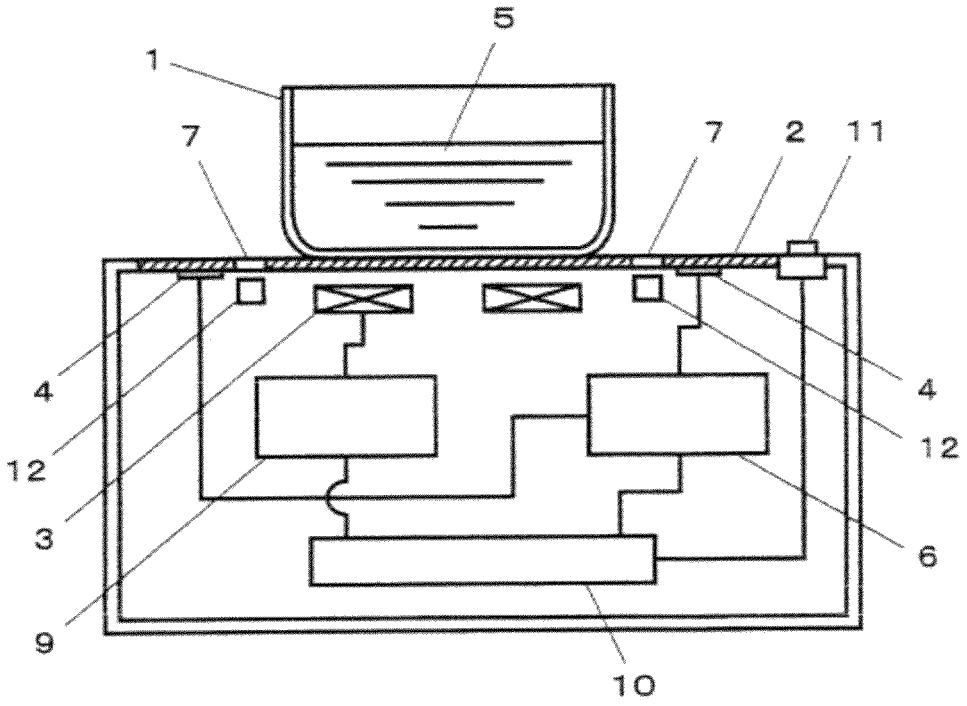
FIG. 1 is a view schematically showing a structure of an induction cooking device according to Embodiment 1 of the present invention.

A first invention provides an induction cooking device comprising: a light-pervious top plate on which a container is to be placed; a heating coil provided below the top plate to heat the container; an electrode provided at a portion of a lower surface of the top plate positioned outer than a periphery of the heating coil; and a capacitance detection device for detecting changes in capacitance of the electrode caused by liquid boiled over from the container, wherein the top plate includes a light emitting part by which visible light applied from a light source placed below the top plate is transmitted to fulfill light emission, the light emitting part being positioned at a portion of the top plate positioned between the periphery of the heating coil and the electrode as viewed from above the top plate.

According to the first the invention, since the light emitting part provided at a portion of the top plate positioned between the periphery of the heating coil and the electrode definitely shows a placement area for the container, placement of the container outside the placement area is suppressed. Since the electrode is positioned outside the placement area, placement of the container at a portion of the top plate positioned above the electrodes is suppressed. Consequently, there can be provided an induction cooking device having a high detection accuracy for the liquid boiled over from the container.

In a second invention, the induction cooking device of the first invention is configured so that the light emitting part is formed into an annular shape having a center positioned nearly identical to a center of the heating coil as viewed from above the top plate.

By the placement area for the container definitely shown by the annular-shaped light emitting part, placement of the container at a portion of the top plate positioned above the electrodes is suppressed.

In a third invention, the induction cooking device of the first invention is configured so that the light emitting part is formed into an arc shape having a center positioned nearly identical to a center of the heating coil as viewed from above the top plate.

By the placement area for the container definitely shown by the arc-shaped light emitting part, placement of the container at a portion of the top plate positioned above the electrodes is suppressed.

In a fourth invention, the induction cooking device of the first invention is configured so that the light emitting part is formed into an arc shape having a center positioned nearly identical to a center of the heating coil, and moreover is placed at a portion of the top plate on a front side of the induction cooking device with respect to the heating coil.

By the arc-shaped light emitting part on the front side of the induction cooking device with respect to the container, placement of the container at a portion of the top plate positioned above the electrodes is suppressed.

In a fifth invention, the induction cooking device of the first invention is configured so that the light source is made variable in its light-application area or light color based on a heating output of the heating coil, and the light emitting part is formed at a portion of the top plate on a front side of the induction cooking device with respect to the heating coil.

As a result of this, placement of the container at a portion of the top plate positioned above the electrodes is suppressed. Moreover, the user can know a heating output of the heating coil by seeing the light emitting part.

In a sixth invention, the induction cooking device of the first invention is configured so that the electrode is formed in a plural-band-like shape along the outer periphery of the heating coil.

As a result of this, with a plurality of electrodes provided, the shorter the electrodes are, the smaller the resistance values between their end portions become, so that changes in capacitance of the electrodes can be detected with higher sensitivity.

In a seventh invention, the induction cooking device of the sixth invention is configured so that the plurality of electrodes are formed in a nearly identical circumference as viewed from above.

As a result of this, a stable detection sensitivity for boiling-over independent of boiling-over directions of the liquid from the container 1 can be achieved by the plurality of electrodes being formed into an arc shape.

Hereinbelow, embodiments of the present invention will be described with reference to the accompanying drawings. It is noted that the invention is not limited by the following embodiments.

Embodiment 1

FIG. 1 is a view schematically showing a structure of an induction cooking device according to a first embodiment of the invention. The induction cooking device shown in FIG. 1 includes a light-pervious top plate 2 on which a container 1 with liquid 5 contained therein is to be placed, heating coils 3 which are provided below the top plate 2 to heat the cooking container 1 and which generates an induction field, a drive circuit 9 for supplying a high-frequency current to the heating coils 3, a heating control part 10 for controlling heating, and an operation part 11 for allowing a user to do such operations as heating start, heating stop and heating output control and for transmitting signals corresponding to those operations to the heating control part 10.

The container 1 is a pan, frying pan, kettle or the like, which is a container to be heated by induction heating. The top plate 2 is made of a light-pervious material such as crystallized glass.

The housing of the induction cooking device is connected to the ground via a power supply cable.

The heating coils 3 generate a high-frequency magnetic field by a high-frequency current supplied from the drive circuit 9.

The container 1, to which a high-frequency magnetic field of each heating coil 3 is applied, is heated by an eddy current generated inside the container 1.

The induction cooking device also includes an electrode 4 for detecting the liquid 5 boiled over from the container 1, and a capacitance detection device 6. The electrode 4 is formed into a band shape and placed at a lower surface of the top plate 2. Also as viewed from above the top plate 2, the electrode 4 is formed into an arc shape having a center nearly identical to a center of the or each heating coil 3. Also, the electrode 4 is provided in plurality, those electrodes being concentric with one another. The electrode 4 is placed outer than the outer periphery of the heating coil 3. The capacitance detection device 6 applies a high-frequency voltage to the electrode 4 and measures a change in the voltage applied to the electrode 4 to thereby detect a change in capacitance of the electrode 4. The electrode 4 may also be provided in singularity as one that is annular-shaped so as to surround the heating coil 3. However, with a plurality of electrodes 4 provided, the shorter the electrodes 4 are, the smaller the resistance values between their end portions become, so that changes in capacitance of the electrodes 4 can be detected with higher sensitivity. Further, forming the electrodes 4 each into an arc shape makes it possible to realize a boiling-over detection sensitivity independent of directions around the container 1 as viewed from the top. Moreover, for supply of the high-frequency voltage to the electrodes 4, auxiliary electrodes (not shown) narrower than the electrodes 4 may be formed on the back face of the top plate 2 and connected to the capacitance detection device 6 at places away from the electrodes 4. The heating control part 10 controls the drive circuit 9 based on a detection result by the capacitance detection device 6 to change the high-frequency current supplied to the heating coils 3 and thereby control the heating output of the heating coils 3.

Each light emitting part 7 is provided at a portion of the top plate 2 between the outer periphery of the heating coil 3 and the electrode 4. The light emitting part 7 transmits a visible light applied from a light source 12 placed below the top plate 2 to thereby emit light.

Figure 2:
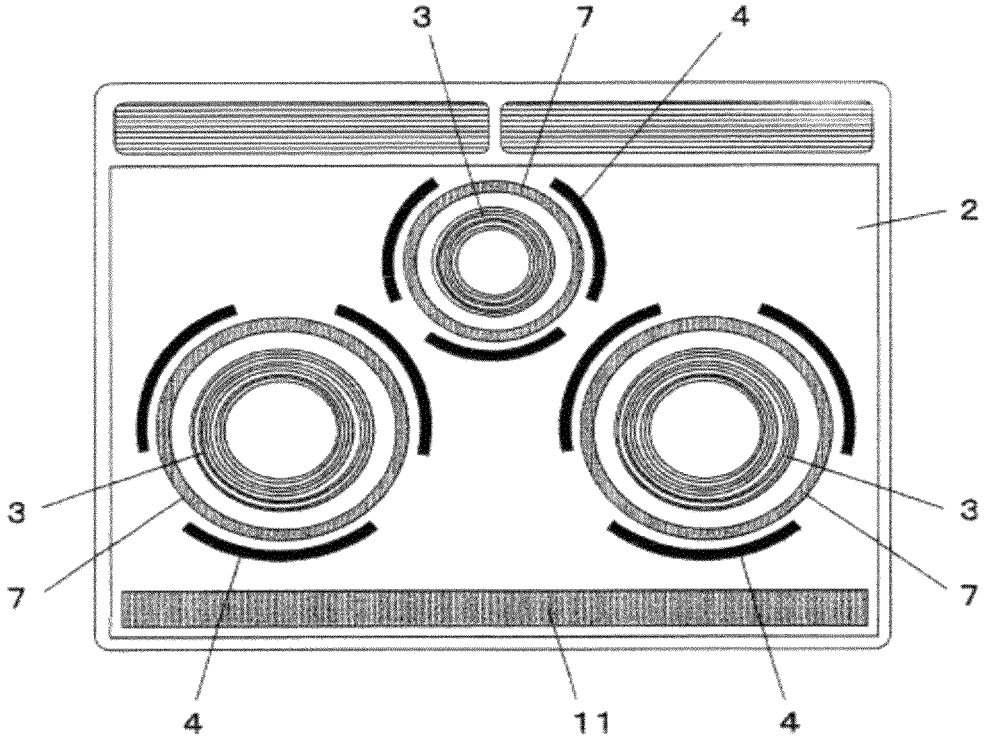
FIG. 2 is a view showing a placement of heating coils, light emitting parts, and electrodes of the induction cooking device according to Embodiment 1 of the invention.

FIG. 2 is a view showing a placement of the heating coils, the light emitting parts, and the electrodes of the induction cooking device according to the first embodiment of the invention. FIG. 2 shows the induction cooking device as viewed from above the top plate 2. One side on which the operation part 11 is present corresponds the front side of the induction cooking device.

As shown in FIG. 2, the heating coils 3 are placed at left, right and central-rear three places. The container 1 is placed and heated on a portion of the top plate 2 positioned above the heating coils 3. Although the rear-side heating coil 3 is smaller in diameter than the left-and-right two heating coils 3 in FIG. 2, yet the present invention is not limited to this. The invention has no limitations on the number, placement and size of the heating coils 3.

As shown in FIG. 2, each light emitting part 7 of the top plate 2 is formed into an annular shape having a center positioned nearly identical to a center of the corresponding heating coil 3.

With respect to the induction cooking device constructed as described above, its operations and functions will be described below.

When the liquid 5, which is a cooking object, is boiled over from the container 1 to a portion of the top plate 2 positioned above the electrodes 4, the capacitance of the electrodes 4 detected by the capacitance detection device 6 is changed. The heating control part 10 controls the drive circuit 9 based on a change in capacitance detected by the capacitance detection device 6 to change the high-frequency current supplied to the heating coils 3, thereby stopping or reducing the heating output of the heating coils 3. As a result, further boiling-over of the liquid 5 from the container 1 is suppressed. Thus, boiling-over of large amounts of the liquid 5 from the container 1 can be suppressed.

In addition, when a large amount of liquid 5 is boiled over from the container 1, there is a possibility that the liquid 5 intrudes inward of the induction cooking device through an exhaust port in a rear portion of the top plate 2 or flows out of the top plate 2. It is difficult to remove the liquid 5 that has intruded inward of the induction cooking device. Also, when the liquid 5 flows out of the top plate 2, cleaning of the overflowing liquid 5 takes time. For these reasons, the amount of the liquid 5 boiled over from the container 1 is suppressed.

However, when the container 1 is placed on a portion of the top plate 2 positioned above the electrodes 4 by the user, it can occur in some cases that the electrodes 4 with the container 1 present upward thereof are kept from changing in capacitance, so that the liquid 5 boiled over from the container 1 cannot be detected. Also, when the container 1 is moved to above an electrode 4 by movement of the container 1 during heating by the user, the electrode 4 changes in capacitance, so that boiling-over of the liquid 5 may be mis-detected in spite of no boiling-over of the liquid 5 from the container 1.

As a means against this, the light emitting part 7 formed into an annular shape is provided at a portion of the top plate 2 positioned between the outer periphery of the heating coils 3 and the electrodes 4. The light emitting part 7 definitely shows an area inner than the annular-shaped light emitting part 7 as a placement area of the container 1 for the user. By this light emitting part 7, placement of the container 1 at a portion of the top plate 2 positioned above the electrodes 4 is suppressed. Consequently, there can be achieved an induction cooking device having a high detection accuracy for the liquid 5 boiled over from the container 1.

Embodiment 2

A second embodiment according to the invention will be described below. The same component members as in Embodiment 1 will be omitted, and differences therefrom only will be described.

Figure 3:
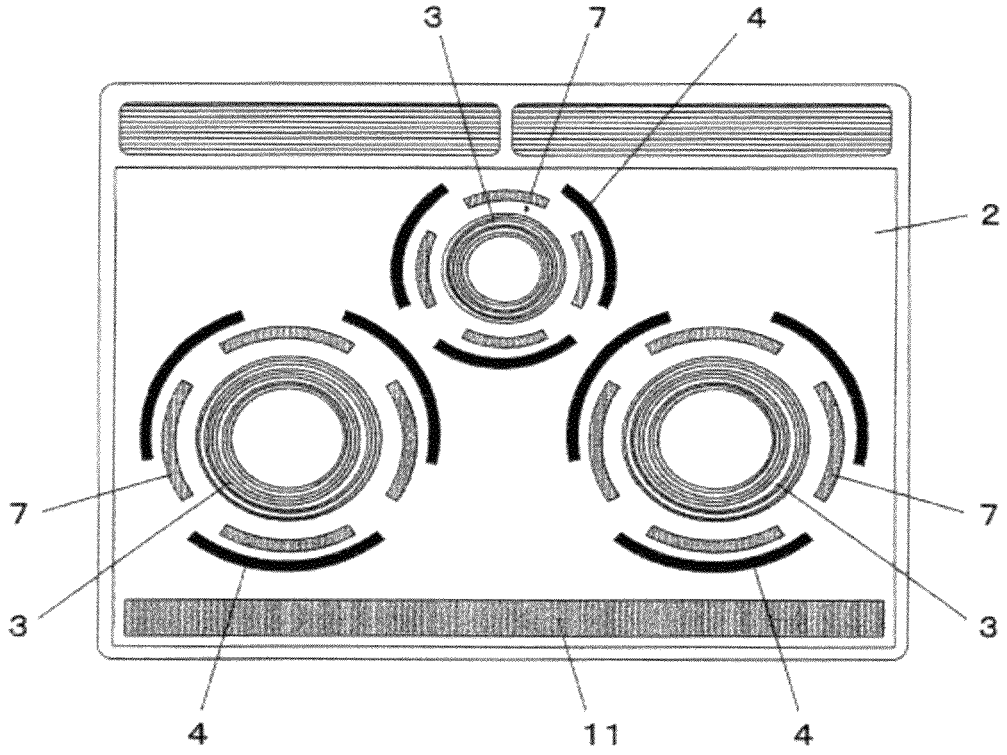
FIG. 3 is a view showing a placement of heating coils, light emitting parts, and electrodes of an induction cooking device according to Embodiment 2 of the invention.

FIG. 3 is a view showing a placement of heating coils, light emitting parts, and electrodes of the induction cooking device according to the second embodiment of the invention.

As shown in FIG. 3, each light emitting part 7 of the top plate 2 is formed into an arc shape having a center positioned nearly identical to a center of the heating coil 3. The light emitting part 7 of this embodiment definitely shows an area inner than the plurality of arc-shaped light emitting parts 7 as a placement area of the container 1 for the user. As a result of this, placement of the container 1 at a portion of the top plate 2 positioned above the electrodes 4 is suppressed as in the first embodiment. Consequently, there can be achieved an induction cooking device having a high detection accuracy for the boiled-over liquid 5.

Embodiment 3

A third embodiment according to the invention will be described below. The same component members as in Embodiment 1 will be omitted, and differences therefrom only will be described.

Figure 4:
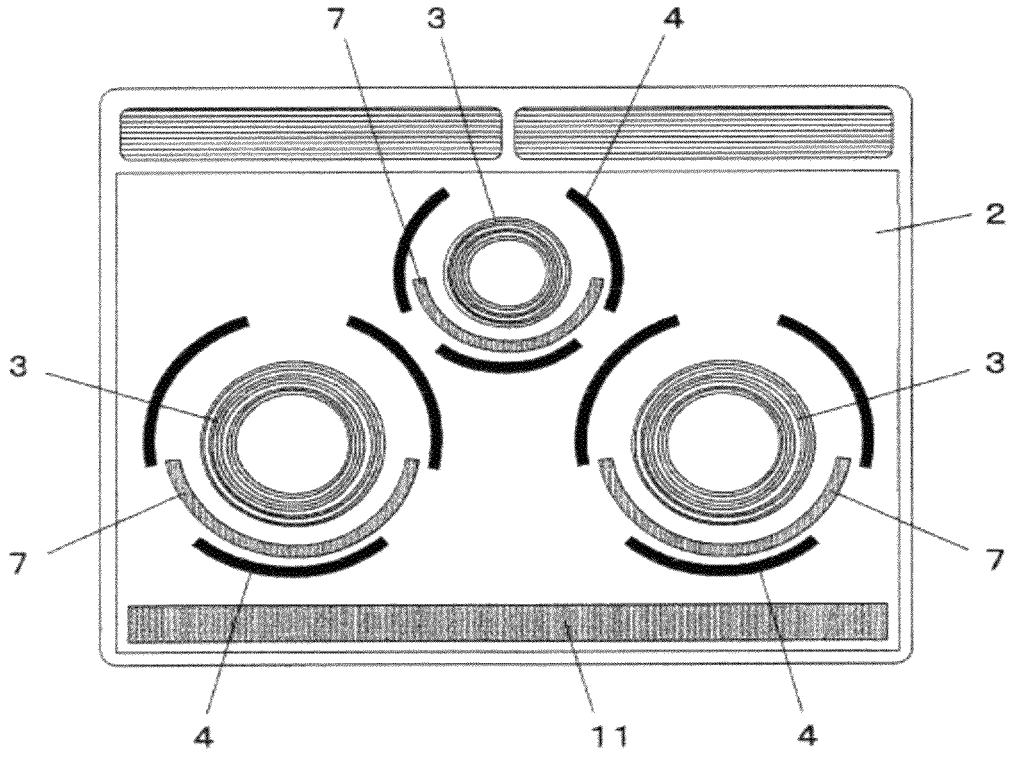
FIG. 4 is a view showing a placement of heating coils, light emitting parts, and electrodes of an induction cooking device according to Embodiment 3 of the invention.

FIG. 4 is a view showing a placement of heating coils, light emitting parts, and electrodes of an induction cooking device according to the third embodiment of the invention.

As shown in FIG. 4, each light emitting part 7 of the top plate 2 is formed into an arc shape having a center positioned nearly identical to a center of the heating coil 3 as viewed from the top, and moreover is placed at a portion of the top plate 2 on a front side of the induction cooking device with respect to the heating coil 3. Actually, by the container 1 interrupting the user's field of view, a portion of the top plate on the rear side of the induction cooking device with respect to the container 1 cannot be seen. Therefore, the light emitting part 7 for definitely showing the placement area for the container 1 has only to be placed on the front side alone of the top plate 2. As a result of this, placement of the container 1 at a portion of the top plate 2 positioned above the electrodes 4 is suppressed as in the first embodiment. Consequently, there can be achieved an induction cooking device having a high detection accuracy for the boiled-over liquid 5.

Embodiment 4

A fourth embodiment according to the invention will be described below. The same component members as in Embodiment 1 will be omitted, and differences therefrom only will be described.

Figure 5:
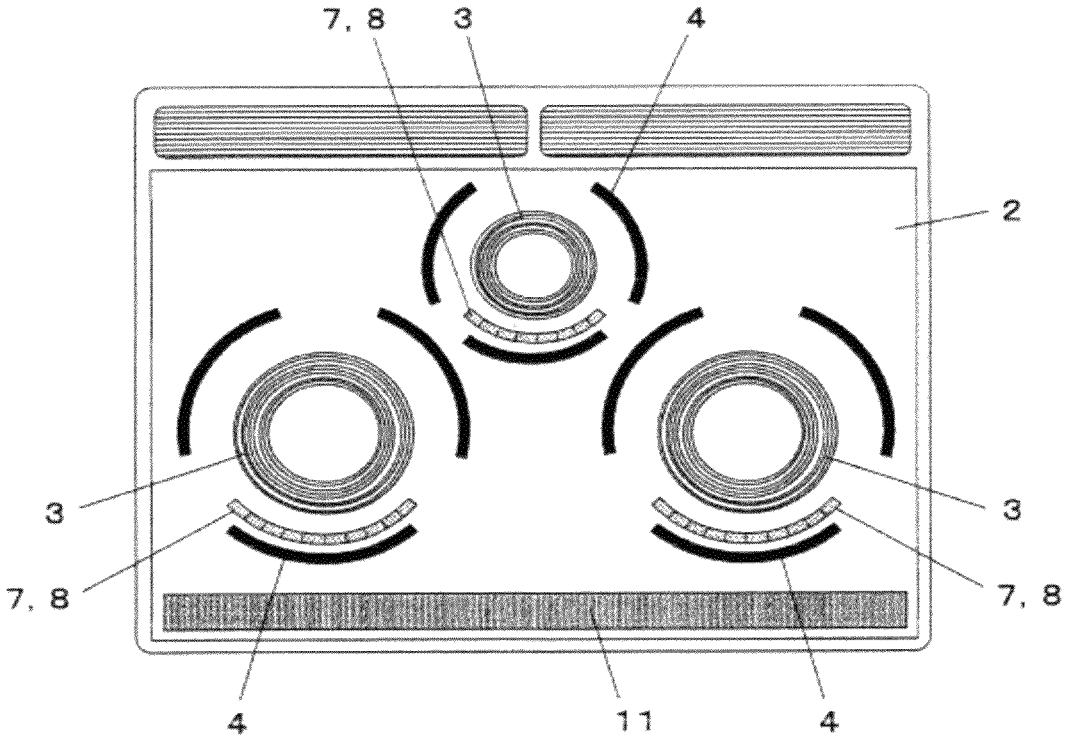
FIG. 5 is a view showing a placement of heating coils, light emitting parts, and electrodes of an induction cooking device according to Embodiment 4 of the invention.

FIG. 5 is a view showing a placement of heating coils, light emitting parts, and electrodes of an induction cooking device according to the fourth embodiment of the invention.

As shown in FIG. 5, each light emitting part 7 of the top plate 2 is formed into a circular-arc shape having a center positioned nearly identical to a center of the heating coil 3, and moreover is placed at a portion of the top plate 2 on a front side of the induction cooking device with respect to the heating coil 3. Also the light emitting part 7 is made so as to be variable in light-emitting area or light-emitting color based on a heating output of the heating coil 3. More concretely, a light source 12 for applying light to the light emitting part 7 is made variable in its light-application area or light color based on a heating output of the heating coil 3. Thus, the light emitting part 7 is enabled to function as a heating output display part 8 for presenting a heating output of the heating coil 3 for the user. Since the user places the container 1 inside the arc-shaped light emitting parts 7 to confirm a heating output of the heating coil 3, placement of the container 1 at a portion of the top plate 2 positioned above the electrodes 4 can be suppressed. Consequently, there can be achieved an induction cooking device having a high detection accuracy for the boiled-over liquid 5.

Although the present invention has been fully described in connection with the preferred embodiments thereof with reference to the accompanying drawings, it is to be noted that various changes and modifications are apparent to those skilled in the art. Such Changes and modifications are to be understood as included within the scope of the present invention as defined by the appended claims unless they depart therefrom.

The entire disclosure of Japanese Patent Applications No. 2010-018168, No. 2010-018170, No. 2010-018171, No. 2010-018172, and No. 2010-018173 all filed on Jan. 29, 2010, including specification, claims, drawings, and summary are incorporated herein by reference in their entirety.

INDUSTRIAL APPLICABILITY

The induction cooking device according to the present invention, in which a placement area for the container with the liquid contained therein is definitely shown to the user, user's placement of the container to a portion of the top plate positioned above the electrodes can be suppressed, and therefore a high detection accuracy for the liquid boiled over from the container can be obtained. Thus, the invention is applicable not only to installation type cooking devices but also to, for example, cooking units integrally incorporated into a system kitchen or induction cooking devices dedicated to household or business use.

The invention claimed is:

1. An induction cooking device comprising:

a light-pervious top plate on that is arranged to support a container;

a heating coil below the top plate to heat the container;

an electrode at a portion of a lower surface of the top plate and outward of a periphery of the heating coil; and a capacitance detection device that detects changes in capacitance of the electrode caused by liquid boiled over from the container, wherein the top plate includes a light emitting part by which visible light applied from a light source below the top plate is transmitted to fulfill light emission, the light emitting part located at a portion of the top plate between the periphery of the heating coil and the electrode, as viewed from above the top plate.

2. The induction cooking device according to claim 1, wherein the light emitting part has an annular shape having a center nearly identical to a center of the heating coil, as viewed from above the top plate.

3. The induction cooking device according to claim 1, wherein the light emitting part has an arc shape having a center nearly identical to a center of the heating coil, as viewed from above the top plate.

4. The induction cooking device according to claim 1, wherein the light emitting part has an arc shape having a center nearly identical to a center of the heating coil, and located at a portion of the top plate on a front side of the induction cooking device with respect to the heating coil.

5. The induction cooking device according to claim 1, wherein the light source is variable in its light-application area or light color, based on a heating output of the heating coil, and the light emitting part is located at a portion of the top plate on a front side of the induction cooking device, with respect to the heating coil.

6. The induction cooking device according to claim 1, wherein the electrode has a plural-band-like shape along the outer periphery of the heating coil.

7. The induction cooking device according to claim 6, wherein the plurality of electrodes have a nearly identical circumference as viewed from above.

* * * * *